US007152656B2

(12) United States Patent
Huang et al.

(10) Patent No.: US 7,152,656 B2
(45) Date of Patent: Dec. 26, 2006

(54) MANUFACTURING METHOD FOR A WAX PATTERN FOR MAKING A GOLF CLUB HEAD

(75) Inventors: Chun-Yung Huang, Kaohsiung Hsien (TW); Chun-Yu Chen, Changhua (TW)

(73) Assignee: Fu-Sheng Industrial Co., Ltd., Taipel (TW)

( * ) Notice: Subject to any disclaimer, the term of this patent is extended or adjusted under 35 U.S.C. 154(b) by 0 days.

(21) Appl. No.: 11/236,498

(22) Filed: Sep. 28, 2005

(65) Prior Publication Data

US 2006/0254741 A1 Nov. 16, 2006

(30) Foreign Application Priority Data

May 16, 2005 (TW) ..... 94115777 A

(51) Int. Cl.
*B22C 7/02* (2006.01)
*B22C 9/04* (2006.01)

(52) U.S. Cl. ..... 164/35; 164/45; 164/516

(58) Field of Classification Search ..... 164/34–36, 164/45, 516–519
See application file for complete search history.

(56) References Cited

U.S. PATENT DOCUMENTS 4,160,313 A * 7/1979 Radford ..... 29/525
5,651,409 A 7/1997 Sheehan
5,651,932 A 7/1997 Butler
5,908,643 A 6/1999 Yost et al.
6,346,052 B1 2/2002 Chappell
6,739,376 B1 5/2004 Cheng et al.
6,805,547 B1 10/2004 Hsu
2005/0140050 A1* 6/2005 Tsai et al. ..... 264/219

FOREIGN PATENT DOCUMENTS

TW 514574 12/2002

* cited by examiner

*Primary Examiner*—Kuang Y. Lin
(74) *Attorney, Agent, or Firm*—Birch, Stewart, Kolasch & Birch, LLP

(57) ABSTRACT

A manufacturing method for a hybrid one-piece design of a wax pattern of a golf club head includes the steps of: prefabricating a first wax pattern in a first molding assembly, the first wax pattern having a connecting portion; inserting the first wax pattern into a first mold cavity of a second molding assembly which has a configuration substantially corresponding to that of a first component of the golf club head; filling liquid wax into a second mold cavity of the second molding assembly which has a configuration substantially corresponding to that of a second component of the golf club head; and cooling the liquid wax in the second mold cavity to form a second wax pattern joined to the connecting portion of the first wax pattern.

20 Claims, 13 Drawing Sheets

MANUFACTURING METHOD FOR A WAX PATTERN FOR MAKING A GOLF CLUB HEAD

BACKGROUND OF THE INVENTION

1. Field of the Invention

The present invention relates to a manufacturing method for a wax pattern for making a golf club head. More particularly, the present invention relates to the manufacturing method for prefabricating a first wax pattern to be joined to a second wax pattern in molding operation to form the wax pattern of the golf club head.

2. Description of the Related Art

A conventional manufacturing method for a golf club head typically includes the following steps:

1. Preparing a mold assembly and filling the mold assembly with liquid wax such that a wax pattern of a golf club head body is formed, when hardened, that permits opening the mold assembly for drawing out the wax pattern;
2. Dipping the wax pattern in slurry to produce a ceramic shell, and melting the wax in the ceramic shell by heating and pouring out the melting wax from the ceramic shell such that a mold cavity for the golf club head body is correspondingly formed in the ceramic shell;
3. Filling a melting metal into the ceramic shell and breaking the ceramic shell for drawing out a casting of the golf club head body when hardened, and the casting of the golf club head body having a connecting portion;
4. Manufacturing a club head component such as a striking plate and weight member by one of dewaxing, casting, forging or mechanical processing; and
5. Assembling the connecting portion of the casting of the golf club head body and the club head component by one of welding, adhesion, snap fitting or screw attachment to constitute the golf club head.

The above-mentioned manufacturing method for the golf club head requires assembling multiple club head components. However, the conventional manufacturing method using separate club head components and golf club head body has several drawbacks. For example, there is unavoidably a good possibility of cracks existing or occurring between the golf club head body and club head components after assembling. Particularly, after the golf club head is in long-term use for striking a golf ball, a golf club head component such as a striking plate may be fallen off from the golf club head body by continuously exerting stresses resulted from striking. Furthermore, it is difficult in manufacturing and assembling the golf club head since the connecting portions of the golf club head body have several sophisticated structure for increasing an assembled relationship that may lengthen manufacture time and burden with manufacture cost.

Referring to FIGS. 1 through 3, Taiwanese Patent Publication No. 514,574, entitled "manufacturing method for a golf club head," discloses an approach to the above problems. The manufacturing method includes the following steps:

1. Separately prefabricating two wax patterns 11, 12 of the golf club head, as shown in FIG. 1, by filling liquid wax into first and second individual mold assemblies (not shown) in molding operation, and drawing out the wax patterns 11, 12 such as a club-head wax pattern and a striking-plate wax pattern from the opened first and second mold assemblies;

2. Adhering the two wax patterns 11, 12 of the golf club head to form a one-piece design of the wax pattern in adhering operation, as shown in FIG. 1;
3. Dipping the combined wax pattern consisting of the two wax patterns 11, 12 in slurry, as shown in FIG. 2, to form a ceramic shell 13 of the golf club head in slurry-dipping operation, and melting the wax patterns 11, 12 of the golf club head in the ceramic shell 13 and pouring out the melting wax from the ceramic shell 13 in dewaxing such that a wax-pattern configuration (including a rear cavity) and a filling aperture of the ceramic shell 13 are correspondingly formed; and
4. Filling a molten iron into the ceramic shell 13 and breaking the ceramic shell 13 for drawing out a casting of the golf club head body 14 when hardened, as shown in FIG. 3.

The casting of the golf club head body 14 is a one-piece member and has a rear cavity 141. In this case, the rear cavity 141 of the golf club head body is advantageously designed to have an undercut structure so as to improve striking ability or designs; even so, the manufacturing method for such an undercut structure of the golf club head body 14 has several drawbacks. For example, in adhering operation, connecting portions of the club-head wax pattern 11 and the striking-plate wax pattern 12 are connected each other by filling with liquid wax. Turning now to FIGS. 1*a*, 2*a* and 3*a*, there is a clearance (designated as "a" in FIG. 1*a*) existing between the connecting portions of the club-head wax pattern 11 and the striking-plate wax pattern 12 if the liquid wax cannot fill up a clearance formed therebetween. When this occurs, slurry can intrude into the clearance "a" between the club-head wax pattern 11 and the striking-plate wax pattern 12 in slurry-dipping operation. This results in remaining burrs (designated as "b" in FIG. 2*a*) in the ceramic shell 13 after dewaxing. Unavoidably, the burrs "b" of the ceramic shell 13 can result in forming a gap (designated as "c" in FIG. 3*a*) in the casting of the golf club head body 14. Consequently, it may deteriorate the quality of the golf club head body 14.

Besides, a filler such as liquid wax, resin, silica gel or hot melt adhesive (designated as a' in FIG. 1*b*) can be used to fill the clearance "a" between the club-head wax pattern 11 and the striking-plate wax pattern 12. Typically, the filler a' has a high degree of viscosity, exceeding 100 cps at 100° C. for example. For this reason it is difficult for the filler a' to fill the clearance "a" between the club-head wax pattern 11 and the striking-plate wax pattern 12 in filling operation. Once dispensed, it is natuarlly very easy to cool and harden the filler a' on the club-head wax pattern 11 and the striking-plate wax pattern 12 in filling operation. Even though the filler a' can fill the clearance "a" in the intended manner, such a filler a' may disadvantageously cause an irregular surface around the clearance "a" when hardened. Hence, there is a need for an additional procedure such as surface finishing for eliminating the irregular surface of the casting (not shown) of the golf club head body 14. This practice naturally necessitates a large operational space for inserting a tool in operating surface finishing. However, it is difficult to operate surface finishing in the rear cavity 141 of the casting of the golf club head body 14 where a space is limited. Hence, there is a need for improving the conventional manufacturing method for the wax pattern of the golf club head.

The present invention intends to provide a wax pattern of a golf club head and a manufacturing method therefor, wherein prefabricating a first wax pattern to be joined to a second wax pattern in molding operation to form a hybrid one-piece design of the wax pattern of the golf club head. The one-piece wax pattern of the golf club head accomplishes a smooth surface between connecting portions of the first and second wax patterns in one-step in such a way to mitigate and overcome the above problem.

SUMMARY OF THE INVENTION

The primary objective of this invention is to provide a manufacturing method for prefabricating a first wax pattern for use in joining to a second wax pattern in molding operation to form a hybrid one-piece design of the wax pattern of the golf club head. Thereby, the manufacturing method can improve the connecting quality of the golf club head; reduce the need for finishing the golf club head; and increase casting quality of the golf club head.

The manufacturing method for the golf club head in accordance with the present invention includes the steps of:

prefabricating a first wax pattern in a first molding assembly, the first wax pattern having a connecting portion;

inserting the first wax pattern into a first mold cavity of a second molding assembly which has a configuration substantially corresponding to that of a first component of the golf club head;

filling liquid wax into a second mold cavity of the second molding assembly which has a configuration substantially corresponding to that of a second component of the golf club head; and cooling the liquid wax in the second mold cavity to form a second wax pattern joined to the connecting portion of the first wax pattern so as to constitute a hybrid one-piece design of the wax pattern of the golf club head for use in casting.

Further scope of the applicability of the present invention will become apparent from the detailed description given hereinafter. However, it should be understood that the detailed description and specific examples, while indicating preferred embodiments of the invention, are given by way of illustration only, since various will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 5:
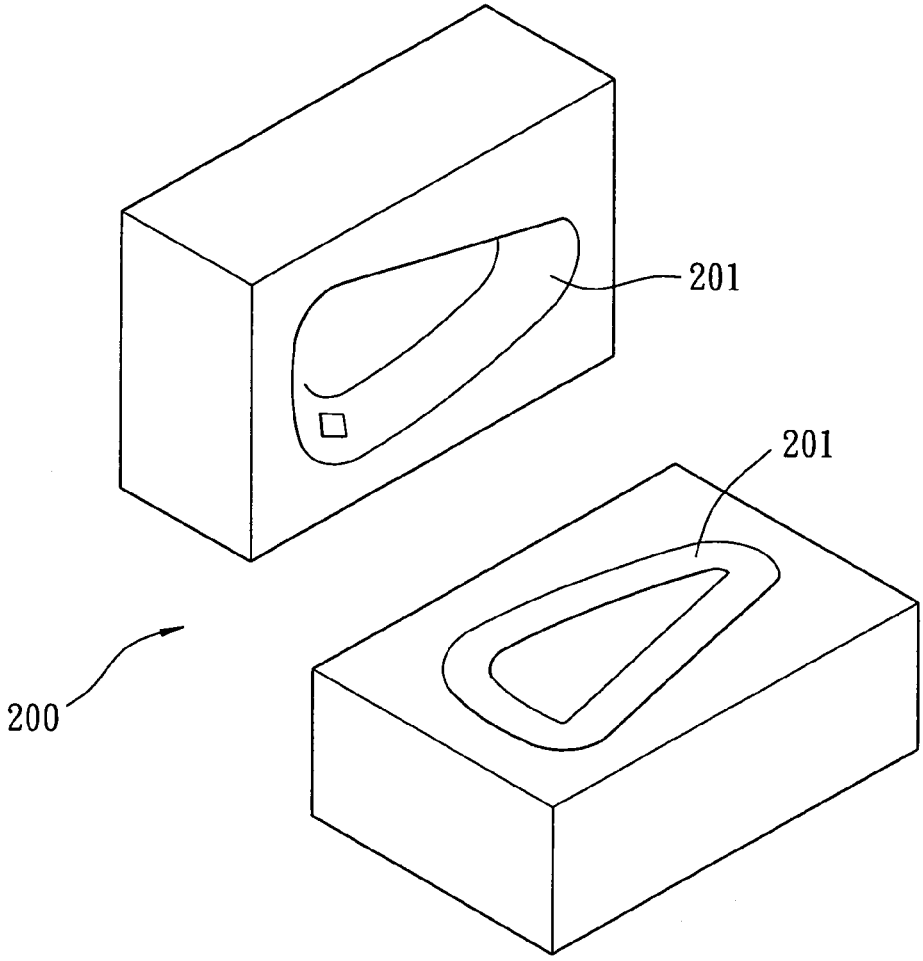
FIGS. 5 through 7 are views in a first step of the manufacturing method for the golf club head in accordance with a first embodiment of the present invention.
Figure 6:
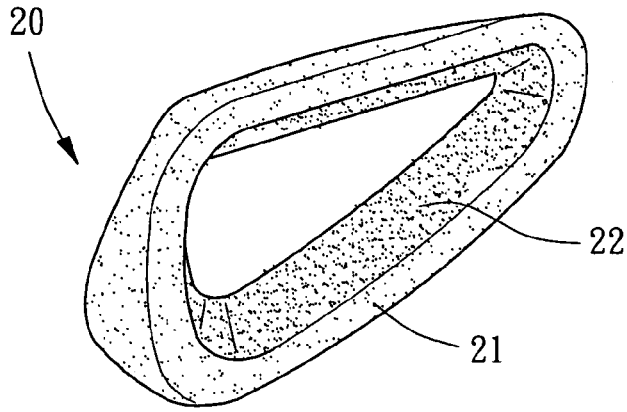
Figure 7:
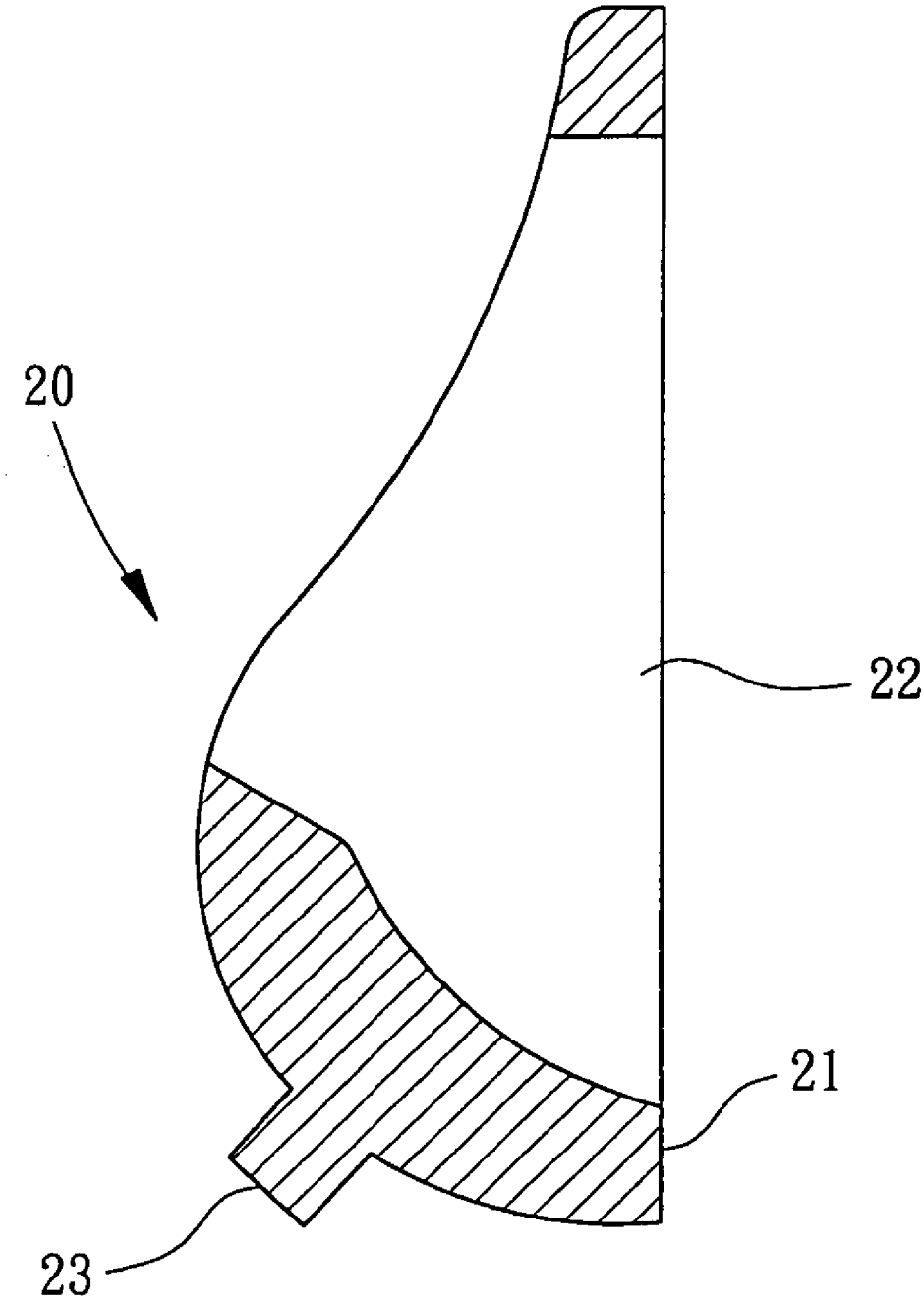
Figure 9:
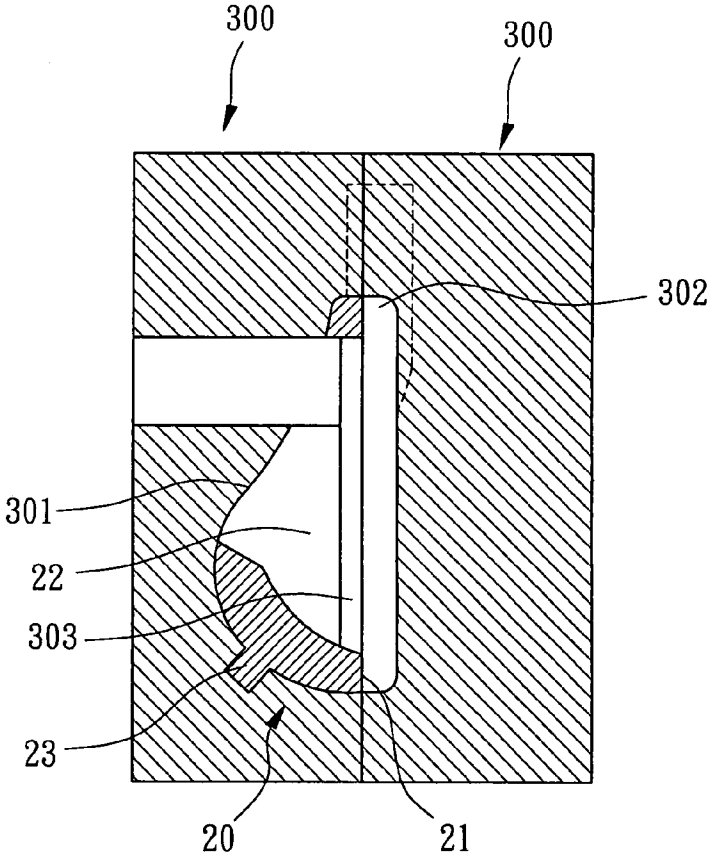
FIGS. 9 and 10 are cross-sectional views in third and fourth steps of the manufacturing method for the golf club head in accordance with the first embodiment of the present invention.
Figure 8:
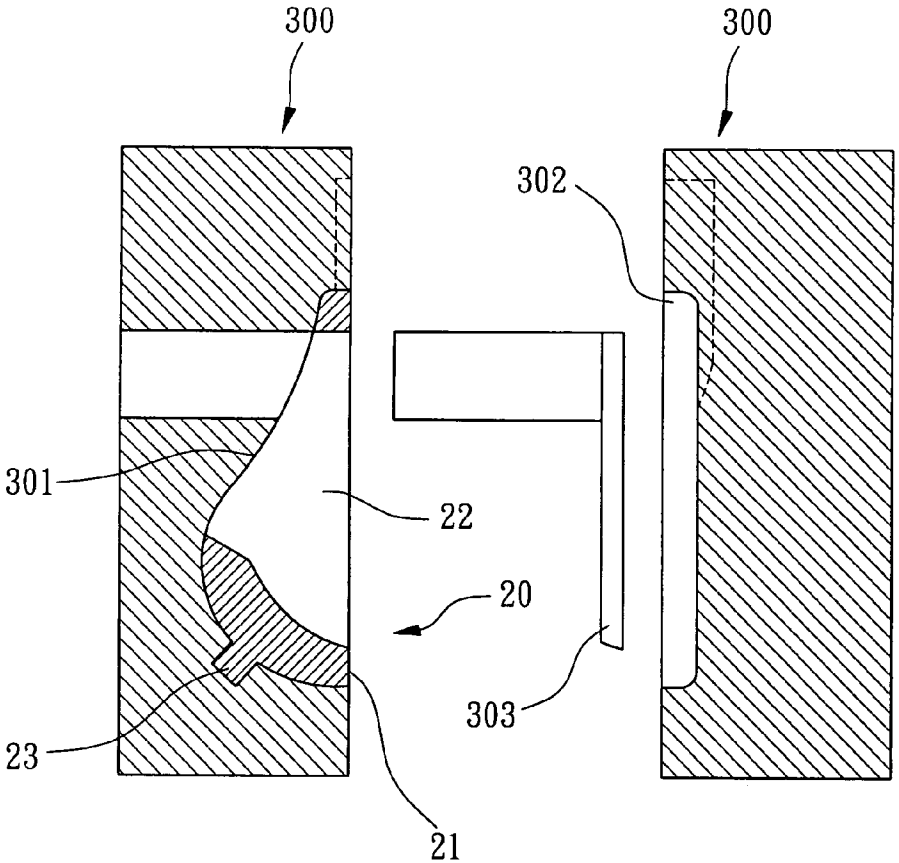
FIG. 8 is a cross-sectional view in a second step of the manufacturing method for the golf club head in accordance with the first embodiment of the present invention.
Figure 10:
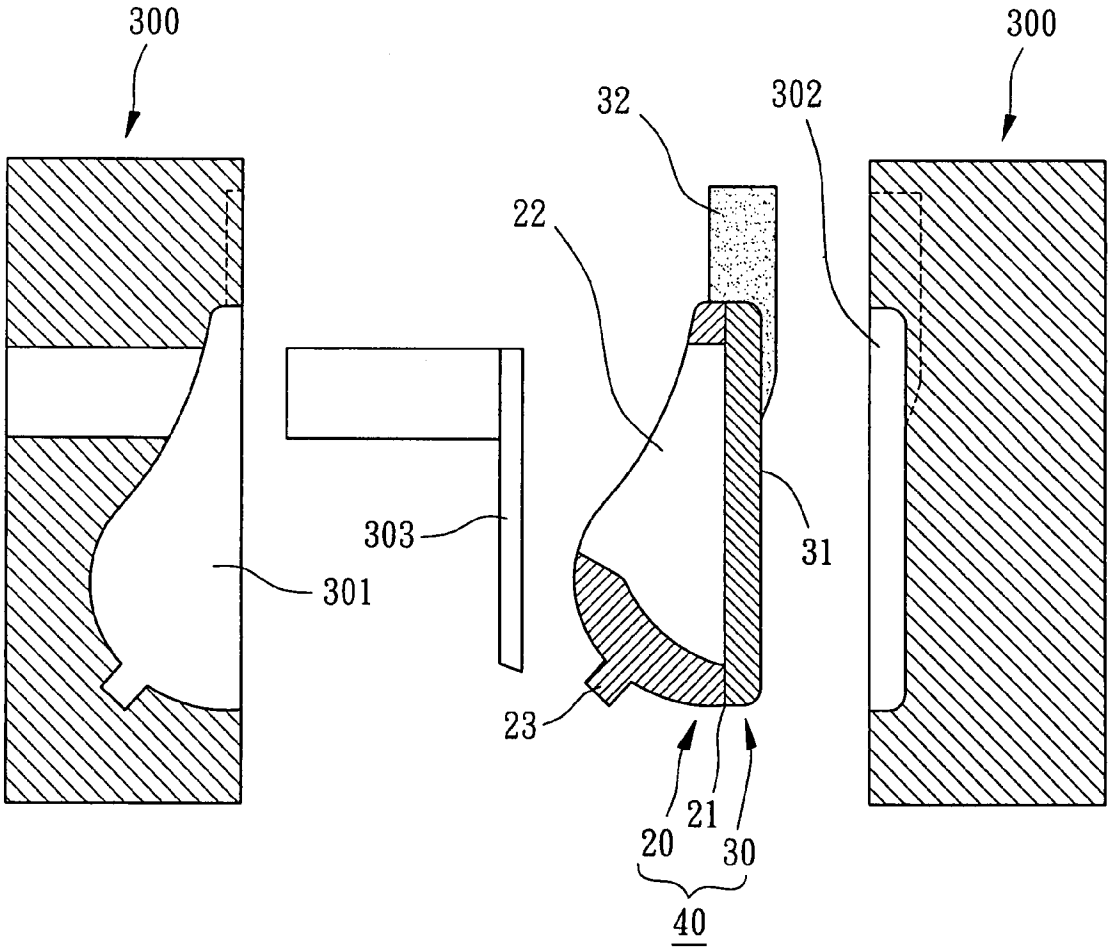
Figure 11:
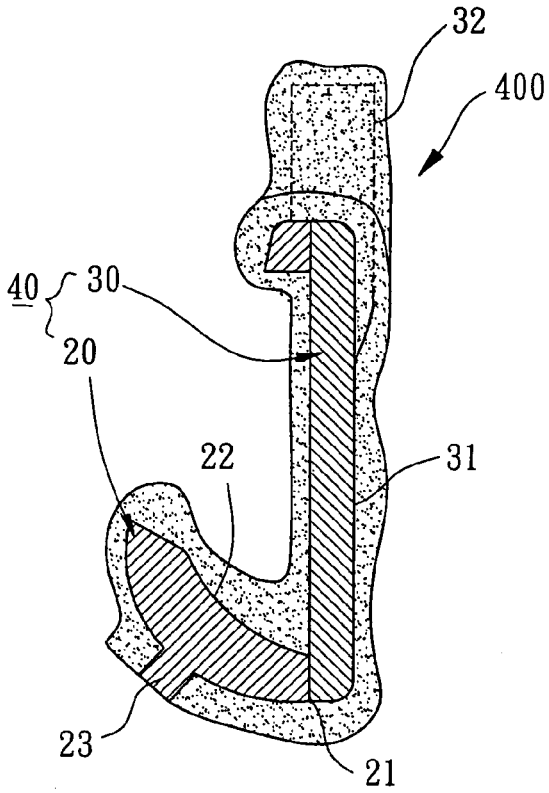
FIGS. 11 and 12 are cross-sectional views in a fifth step of the manufacturing method for the golf club head in accordance with the first embodiment of the present invention.
Figure 12:
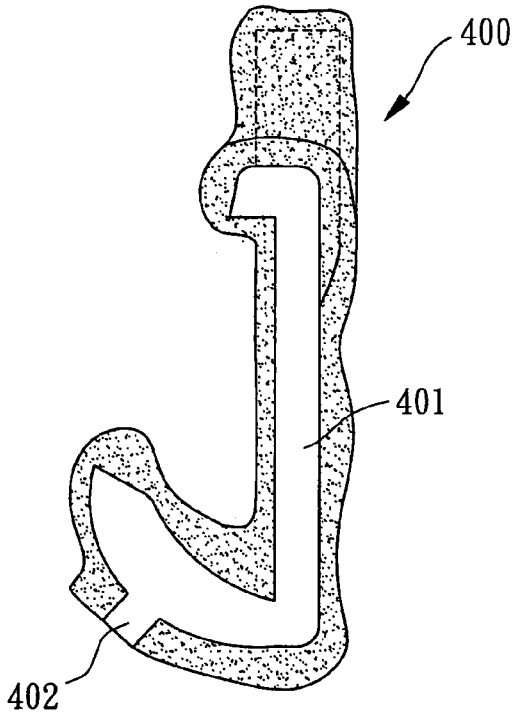
Figure 13:
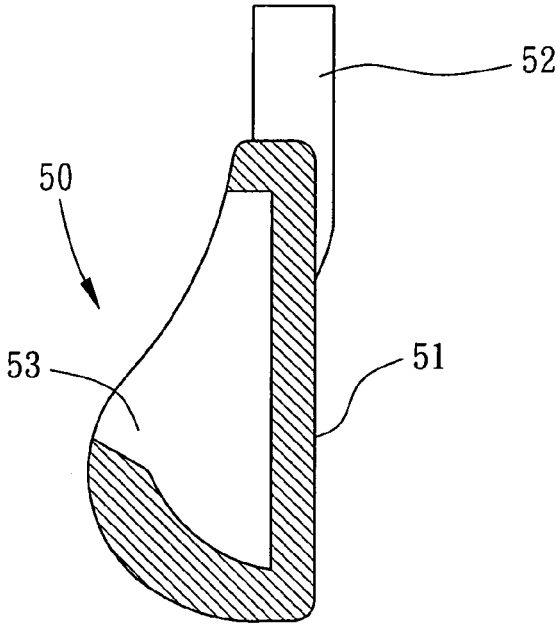
FIG. 13 is a cross-sectional view in a sixth step of the manufacturing method for the golf club head in accordance with the first embodiment of the present invention.

Referring to FIGS. 4 through 13, a manufacturing method for a golf club head in accordance with a first embodiment of the present invention includes the steps of:

1. Prefabricating a first wax pattern 20 in a first molding assembly 200, and the first wax pattern 20 having a connecting portion 21, as best shown in FIGS. 5 through 7;
2. Inserting the first wax pattern 20 into a first mold cavity 301 of a second molding assembly 300, and the first mold cavity 301 having a configuration substantially corresponding to that of a first component of the golf club head, as best shown in FIG. 8;
3. Filling liquid wax into a second mold cavity 302 of the second molding assembly 300, and the second mold cavity 302 having a configuration substantially corresponding to that of a second component of the golf club head, as best shown in FIG. 9;
4. Cooling the liquid wax in the second mold cavity 302 of the second molding assembly 300 to form a second wax pattern 30, and the second wax pattern 30 joined to the connecting portion 21 of the first wax pattern 20 to constitute a hybrid one-piece design of a wax pattern 40, as best shown in FIG. 10;
5. Dipping the wax pattern 40 of the golf club head in slurry to form a ceramic shell 400, and melting the wax pattern 40 in the ceramic shell 400 in dewaxing, as best shown in FIGS. 11 and 12; and 6. Forming a casting 50 in the ceramic shell 400 in casting, as best shown in FIG. 13.

Referring back to FIGS. 4 through 7, in the first step of the manufacturing method for the golf club head in accordance with the first embodiment of the present invention the first wax pattern 20 is prefabricated in the first molding assembly 200, and the first wax pattern 20 forms the connecting portion 21. The first molding assembly 200 has a mold cavity 201 which has a configuration substantially corresponding to the first component of the golf club head. The first molding assembly 200 is filled with liquid wax to form the first wax pattern 20. In an alternative embodiment, the first wax pattern 20 has an ordinary or common shape selected from a group of components of the golf club head consisting of a rear-assembling weight component, a club head body and a weight member for example. In the first embodiment, it will be understood that the shape of the first wax pattern 20 is designed to exemplify a rear-assembling weight component of the golf club head. In the first embodiment, the first wax pattern 20 further includes a rear cavity 22 connecting between a front side and a rear side in addition to the first connecting portion 21. The first connecting portion 21 is located on the front side of the first wax pattern 20 delimiting a front rim of the rear cavity 22. Preferably, the rear cavity 22 has an ordinary or common shape of an undercut cavity. Furthermore, the first wax pattern 20 has a pouring-gate portion 23 so as to form a pouring gate of the ceramic shell for use in the casting procedure.

Referring again to FIGS. 4 and 8, in the second step of the manufacturing method for the golf club head in accordance with the first embodiment of the present invention the first wax pattern 20 is inserted into the first mold cavity 301 of the second molding assembly 300, and the first mold cavity 301 has a configuration substantially corresponding to that of the rear-assembling weight component of the golf club head. The second molding assembly 300 includes the first mold cavity 301 and the second mold cavity 302 having configurations substantially corresponding to those of a first component and a second component of the golf club head. In the first molding assembly 200 the connecting portion 21 of the first wax pattern 20 is in perfect alignment with the second mold cavity 302 when the first wax pattern 20 is mounted in the first mold cavity 301. At least one mold core 303 is disposed in the second molding assembly 300 after the first wax pattern 20 is inserted into the first mold cavity 301 of the second molding assembly 300. In the first embodiment, the mold core 303 can be constructed from a one-piece member or a multi-piece member which is made from a heat-resistant resilient material in aid of drawing out the mold core 303 from the second molding assembly 300. In the second molding assembly 300, the mold core 303 can correspondingly engage with an inner wall of the rear cavity 22 of the first wax pattern 20 proximate to the connecting portion 21 in order to seal the rear cavity 22 of the first wax pattern 20. This insures no leakage of the liquid wax occurring between the first wax pattern 20 and the mold core 303, or flowing into the rear cavity 22 of the first wax pattern 20.

Referring again to FIGS. 4, 9 and 10, in the third step of the manufacturing method for the golf club head in accordance with the first embodiment of the present invention the second mold cavity 302 of the second molding assembly 300 is filled with liquid wax, and the second mold cavity 302 has a configuration substantially corresponding to that of the second component of the golf club head. In the fourth step of the manufacturing method for the golf club head in accordance with the first embodiment of the present invention the liquid wax cooled and hardened in the second mold cavity 302 of the second molding assembly 300 to form a second wax pattern 30, and the second wax pattern 30 is joined to the connecting portion 21 of the first wax pattern 20 to constitute a hybrid one-piece design of a wax pattern 40. In an alternative embodiment, the second wax pattern 30 has an ordinary or common shape selected from a group of components of the golf club head consisting of a striking plate body, a striking plate, a hosel and a cover plate (i.e. crown plate, skirt plate or sole plate) for example. In the first embodiment, the shape of the second wax pattern 30 is designed to exemplify a striking plate body. The second wax pattern 30 includes a striking face 31 and a hosel 32. In filling operation, the second mold cavity 302 of the second molding assembly 300 will be gradually filled with liquid wax. Subsequently, once the heated liquid wax flows to the connecting portion 21 of the first wax pattern 20, the heat of the liquid wax fuses the connecting portion 21 and blends with the melting wax of the first wax pattern 20. Once cooled and hardened, a joint between the first wax pattern 20 and the second wax pattern 30 are in a perfectly connecting quality without using any filling material (such as an adhesion of liquid wax). Consequently, a hybrid one-piece design of the wax pattern 40 of the golf club head is formed. Hence, there is no need for designing a complicated structure of a sectional mold core for the second molding assembly 300 for forming the rear cavity 22 of the first wax pattern 20 so that the manufacture process for the molding assembly is simplified and the manufacture cost is reduced. As such, the wax pattern 40 can further avoid forming the parting lines of the molding assembly due to the conventional sectional mold core.

Referring again to FIGS. 4, 11 and 12, in the fifth step of the manufacturing method for the golf club head in accordance with the first embodiment of the present invention the wax pattern 40 the golf club head is dipped in slurry to form a ceramic shell 400, and subsequently the ceramic shell 400 is heated to melt the wax pattern 40 in the ceramic shell 400 in dewaxing operation. The ceramic shell 400 is formed from the wax pattern 40 by an ordinary slurry-dipping and sand floating technology. The ceramic shell 400 includes a mold cavity 401 and a pouring gate 402 connected thereto. The melting wax pattern 40 can be poured out from the pouring gate 402 of the ceramic shell 40 after the ceramic shell 40 is dried and hardened.

Referring again to FIGS. 4, 12 and 13, in the sixth step of the manufacturing method for the golf club head in accordance with the first embodiment of the present invention a casting 50 is formed in the ceramic shell 400 in casting operation. A molten iron (not shown) is filled in the mold cavity 401 of the ceramic shell 400 via the pouring gate 402 after the ceramic shell 400 is dewaxed. Such practice may manufacture a one-piece design of the casting 50. The casting 50 includes a striking face 51, a hosel 52 and a rear cavity 53, and the rear cavity 53 has an undercut structure according to the design need. As shown in FIG. 13, there is no clearance formed on a boundary defined between a rear surface of the striking face 51 and the rear cavity 53. Hence, there is no need for an additional procedure such as surface finishing for eliminating the irregular surface in the rear cavity 53 of the casting 50 of the golf club head body. In addition, there is no need for a great quality for surface finishing and eliminating the irregular surface on the surface of the casting 50 of the golf club head body.

Figure 14:
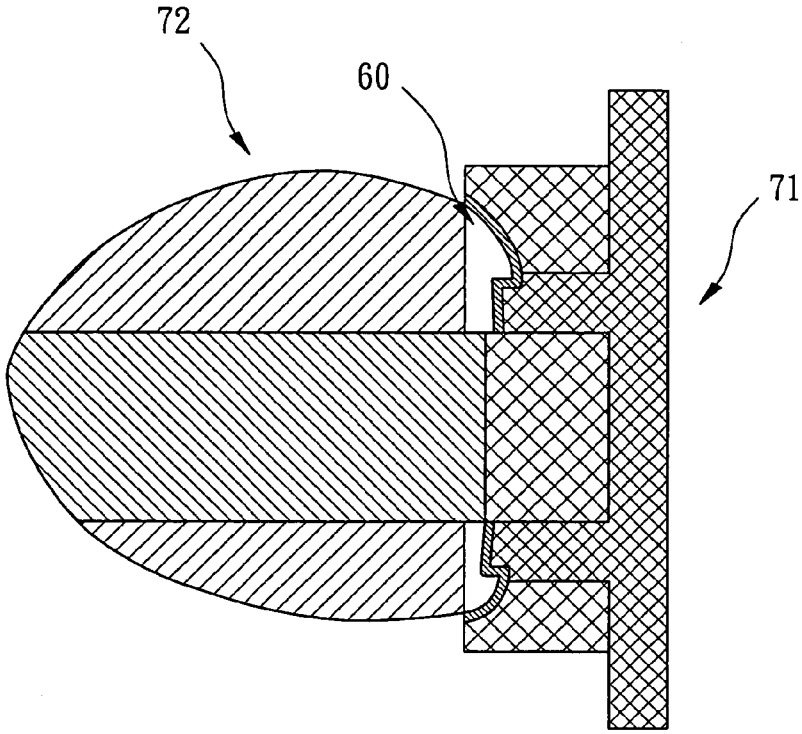
FIG. 14 is a cross-sectional view in a first step of the manufacturing method for the golf club head in accordance with a second embodiment of the present invention.
Figure 15:
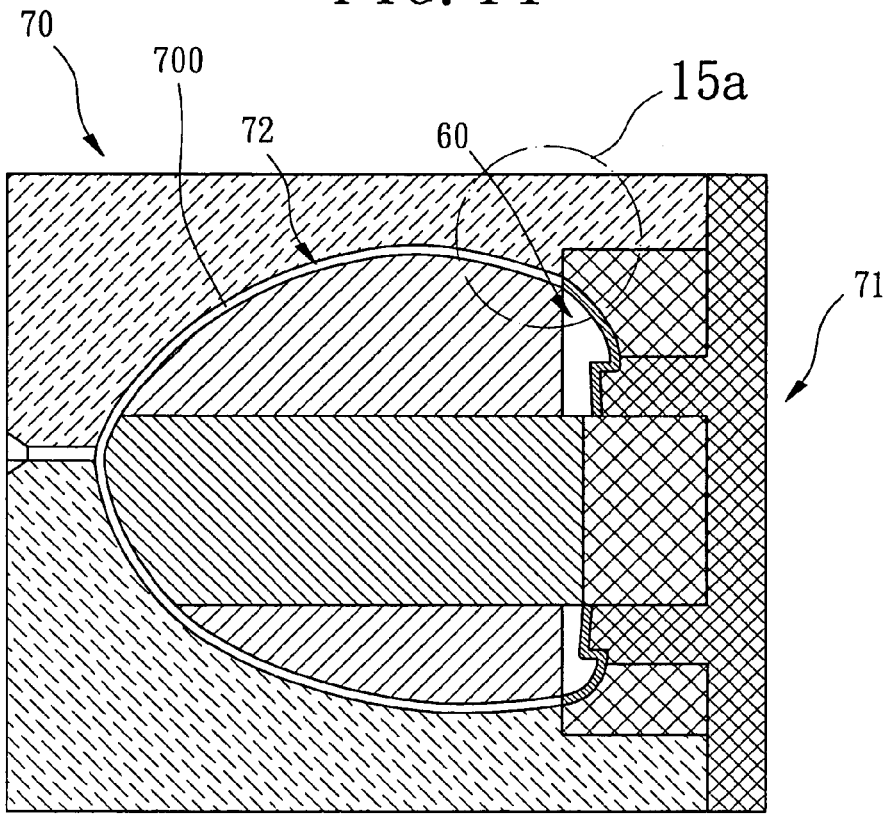
FIG. 15 is a cross-sectional view in a second step of the manufacturing method for the golf club head in accordance with the second embodiment of the present invention.
Figure 15A:
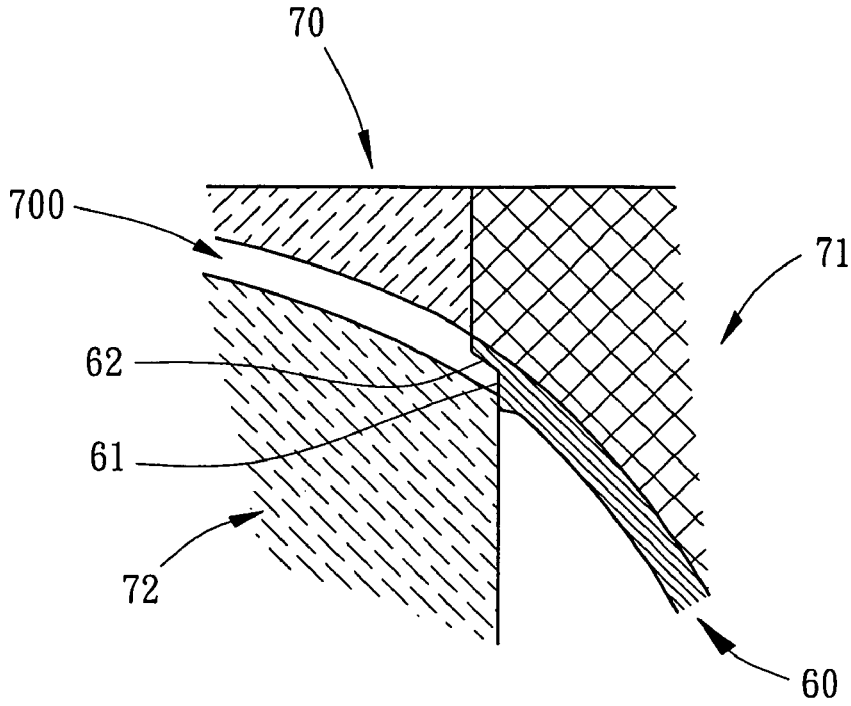
FIGS. 15*a*–15*d* is enlarged cross-sectional views, in FIG. 15, in the second step of the manufacturing method for the golf club head in accordance with the second embodiment of the present invention.
Figure 15B:
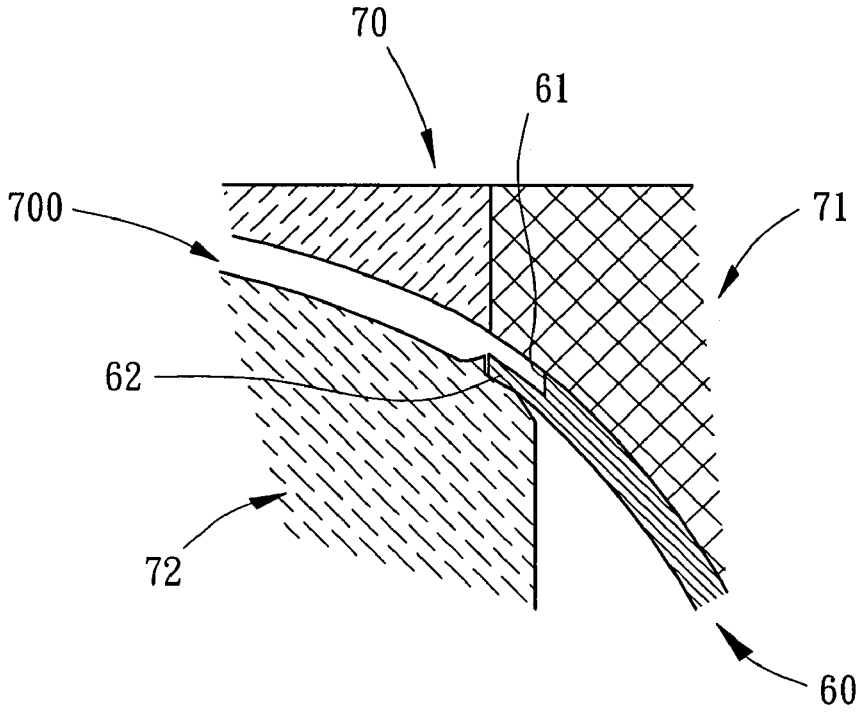
Figure 15C:
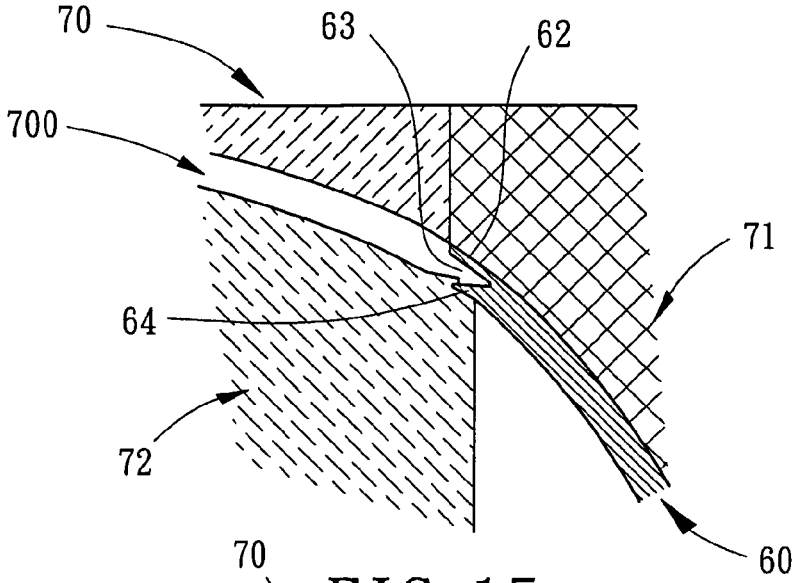
Figure 15D:
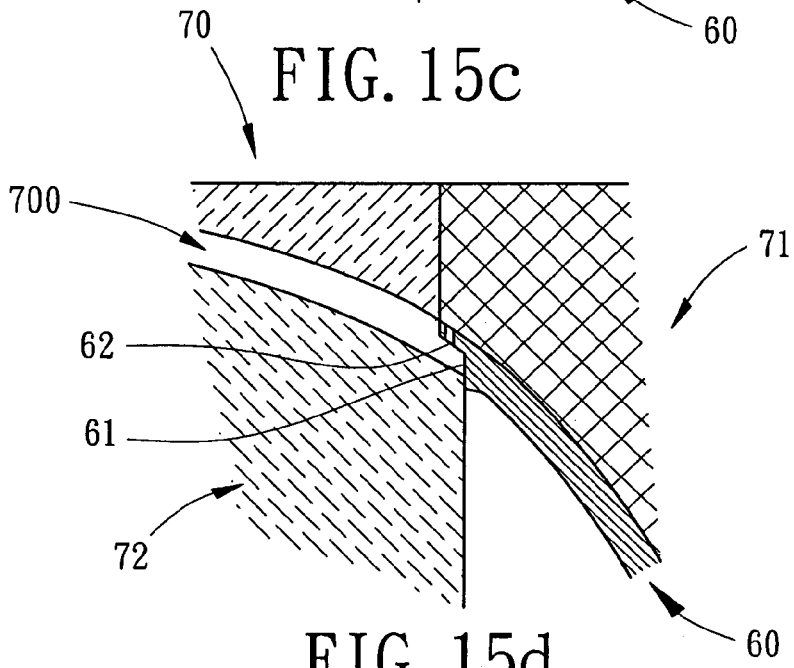
Figure 15E:
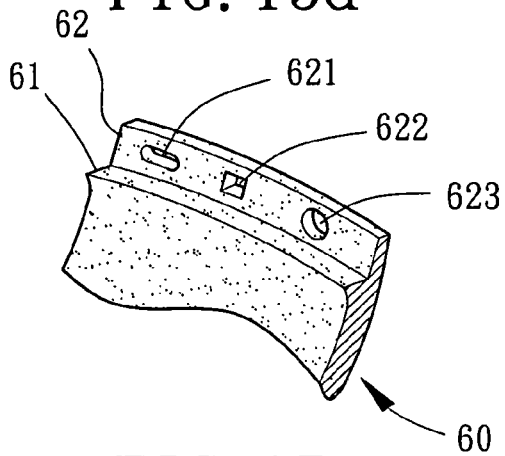
FIG. 15*e* is an enlarged perspective view of the first wax pattern of the golf club head in accordance with the second embodiment of the present invention.

Turning now to FIGS. 14 and 15, the manufacturing method of the golf club head in accordance with the second embodiment of the present invention has the same method of the first embodiment. In comparison with the first embodiment, the first wax pattern of the second embodiment is selected from a front-assembling component 60 of the golf club head, but the front-assembling component 60 does not have a striking face. The first wax pattern (i.e. front-assembling component 60) is prefabricated in a first molding assembly, similarly shown as 200 in FIG. 5. Furthermore, a second molding assembly consists of a plurality of mold supports 71, a plurality of mold cores 72 and a plurality of outer molds 70. The mold supports 71 and the mold cores 72 are sectional mold members, and commonly form a first mold cavity (not labeled), in assembling operation, corresponding to a front-assembling component 60 of the golf club head. Subsequently, the first wax pattern is inserted into the first mold cavity of the second molding assembly, and the outer molds 70 and the mold cores 72 further commonly form a second mold cavity 700 corresponding to a rear-assembling component of the golf club head.

Figure 16:
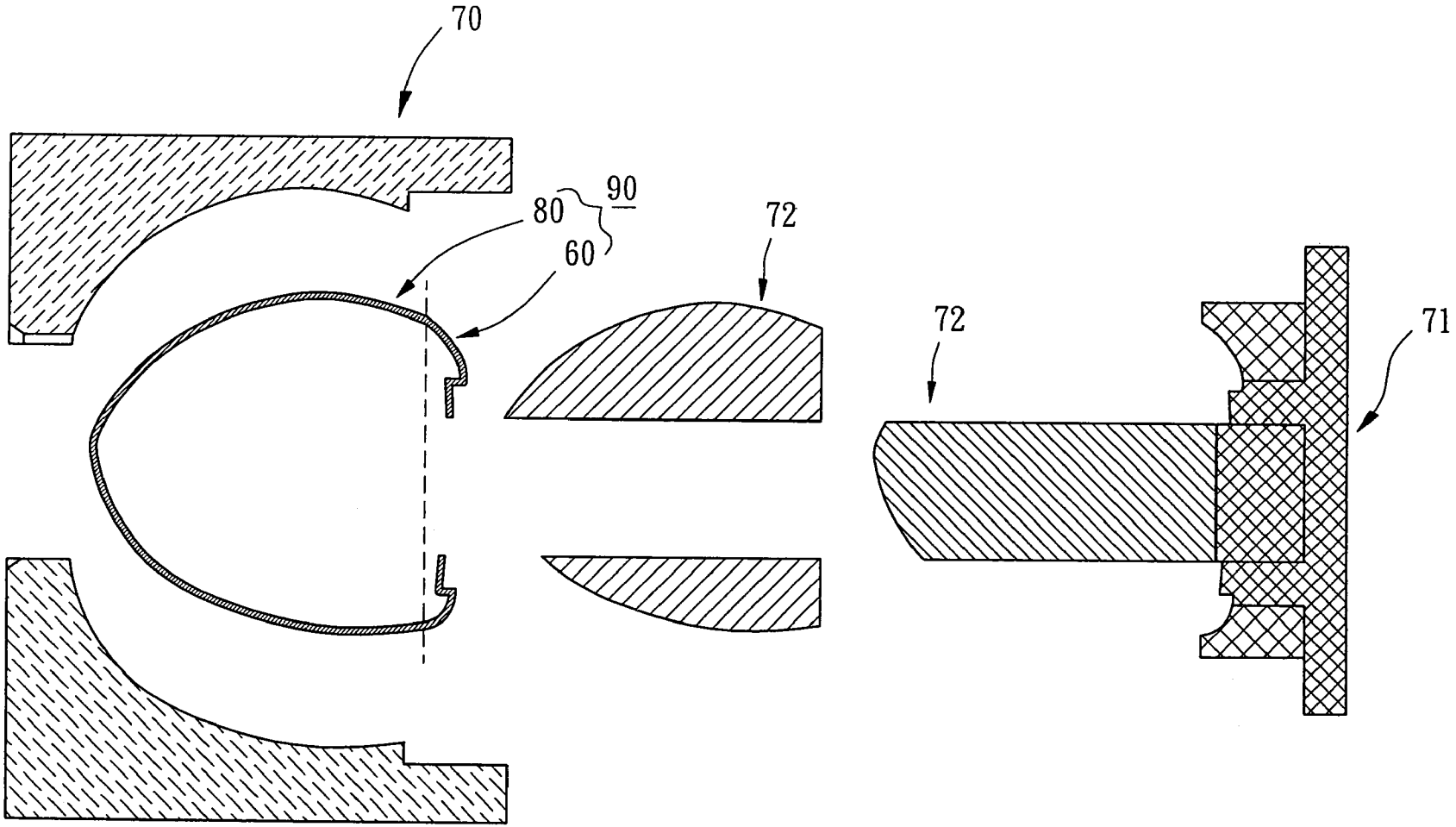
FIG. 16 is a cross-sectional view in third and fourth steps of the manufacturing method for the golf club head in accordance with the second embodiment of the present invention.

Turning now to FIG. 16, a second wax pattern is fabricated in the second cavity 700 of the second molding assembly such that the second wax pattern forms a rear-assembling component 80. Consequently, a hybrid one-piece design of the wax pattern 90 of the golf club head is formed to be for use in slurry-dipping, sand floating, dewaxing and casting operation. Hence, there is no need for designing a complicated structure of a sectional mold core for the second molding assembly for forming the front-assembling component 60 so that the manufacture process for the molding assembly is simplified and the manufacture cost for the sectional mold cores 72 is reduced. As such, the wax pattern 90 can further avoid the difficulties in forming an undercut configuration of the molding assembly by using the conventional sectional mold core.

Turning now to FIGS. 15*a* through 15*e*, the front-assembling component 60 of the first wax pattern can be designed for varying in shapes of the connection portions so as to increase a connecting area, reliability and sealing effect between the front-assembling component 60 and the rear-assembling component 80.

Referring again to FIG. 15*a*, the connecting portion of the front-assembling component 60 includes a stepped portion 61 and an annular flange portion 62 having an inner wall delimiting the stepped portion 61. In assembling, the stepped portion is used to engage with the mold cores 72 so that no leakage occurring in a free space formed between the front-assembling component 60 and the mold cores 72 when the second mold cavity 700 is filled with liquid wax.

Referring again to FIG. 15*b*, in an alternative embodiment, the connecting portion of the front-assembling component 60 includes a stepped portion 61 and an annular flange portion 62 having an outer wall delimiting the stepped portion 61.

Referring again to FIG. 15*c*, in an alternative embodiment, the connecting portion of the front-assembling component 60 includes an annular inner flange portion 62, an annular groove 63 and an annular outer flange portion 64, wherein the annular inner flange portion 62 and the annular outer flange portion 64 commonly define the annular groove 63, and engages with the mold core 72.

Referring again to FIGS. 15*d* and 15*e*, in an alternative embodiment, the connecting portion of the front-assembling component 60 includes a stepped portion 61 and an annular flange portion 62, wherein the annular flange portion 62 further includes assembling holes 621, 622, 623. Preferably, the assembling holes 621, 622, 623 can be designed to have various shapes, such as an ellipse hole, a square hole, a circular hole, a rectangular hole and triangle hole etc. Consequently, the assembling holes 621, 622, 623 may increase connecting reliability between the front-assembling component 60 and the rear-assembling component 80.

Figure 1:
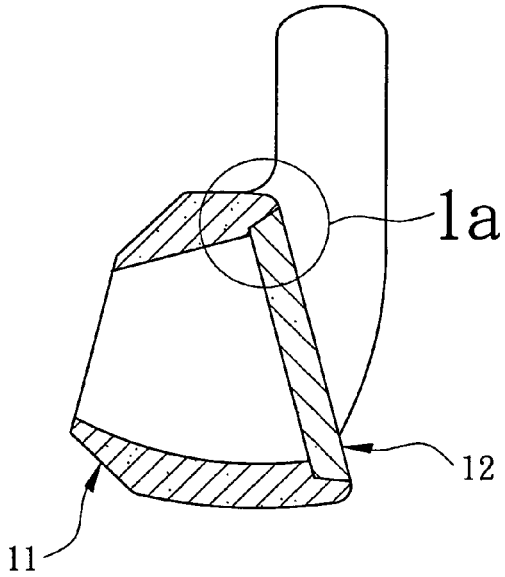
FIG. 1 PRIOR ART
FIG. 1 is a cross-sectional view of a wax pattern for manufacturing a golf club head in accordance with the prior art.
Figure 1A:
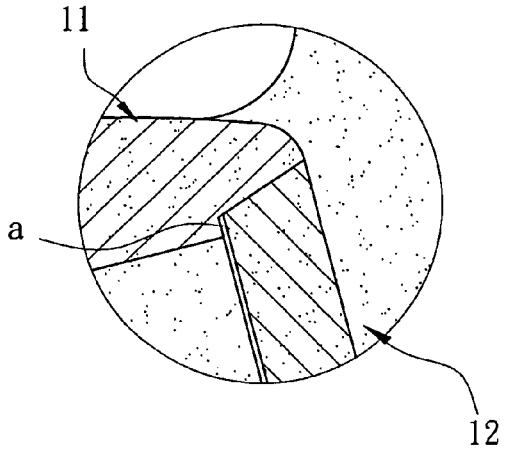
FIG. 1a PRIOR ART
FIG. 1*a* is an enlarged cross-sectional view, in FIG. 1, of the wax pattern for manufacturing the golf club head in accordance with the prior art.
Figure 1B:
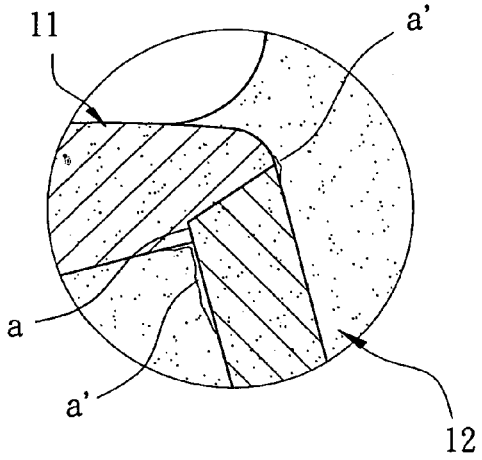
FIG. 1b PRIOR ART
FIG. 1*b* is another enlarged cross-sectional view, similar to FIG. 1*a*, of the wax pattern for manufacturing the golf club head in accordance with the prior art.
Figure 2:
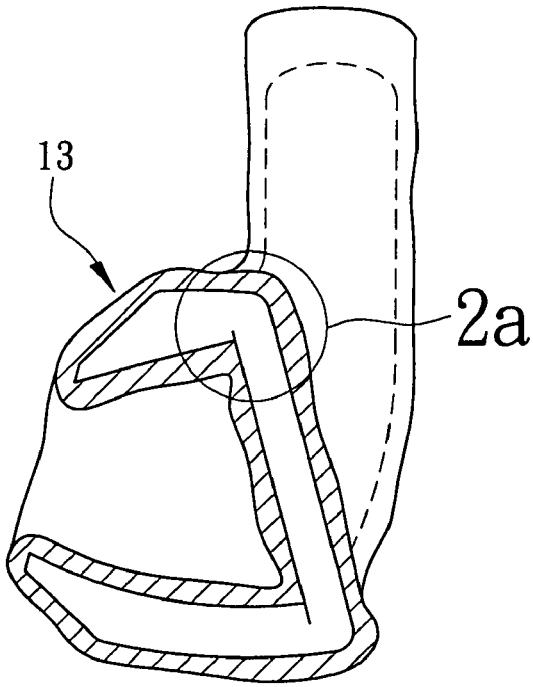
FIG. 2 PRIOR ART
FIG. 2 is a cross-sectional view of a ceramic shell for manufacturing golf club head in accordance with the prior art.
Figure 2A:
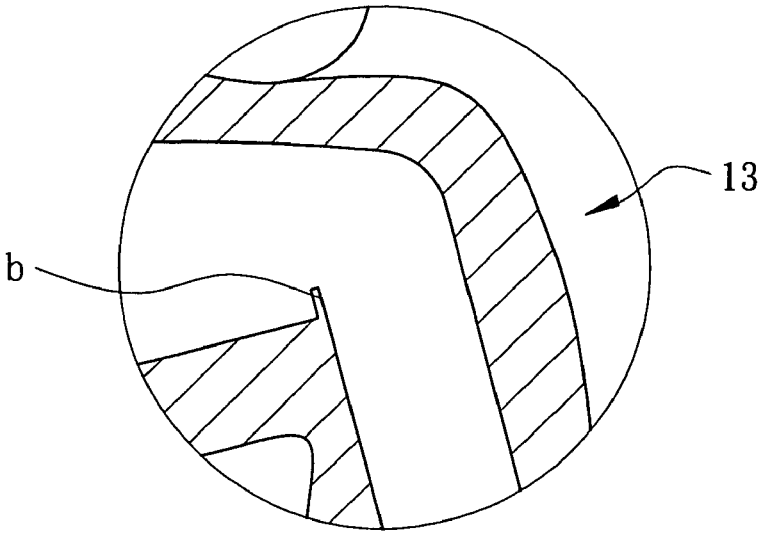
FIG. 2a PRIOR ART
FIG. 2*a* is an enlarged cross-sectional view, in FIG. 2, of the ceramic shell for manufacturing the golf club head in accordance with the prior art.
Figure 3:
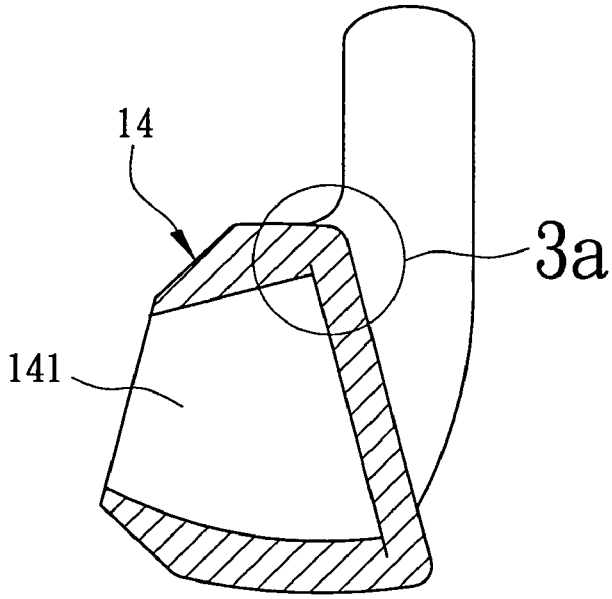
FIG. 3 PRIOR ART
FIG. 3 is a cross-sectional view of a casting for manufacturing golf club head in accordance with the prior art.
Figure 3A:
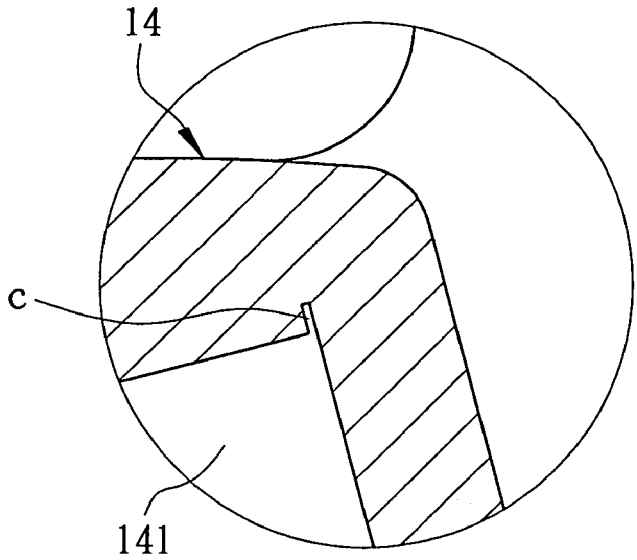
FIG. 3a PRIOR ART
FIG. 3*a* is an enlarged cross-sectional view, in FIG. 3, of the casting for manufacturing the golf club head in accordance with the prior art.
Figure 4:
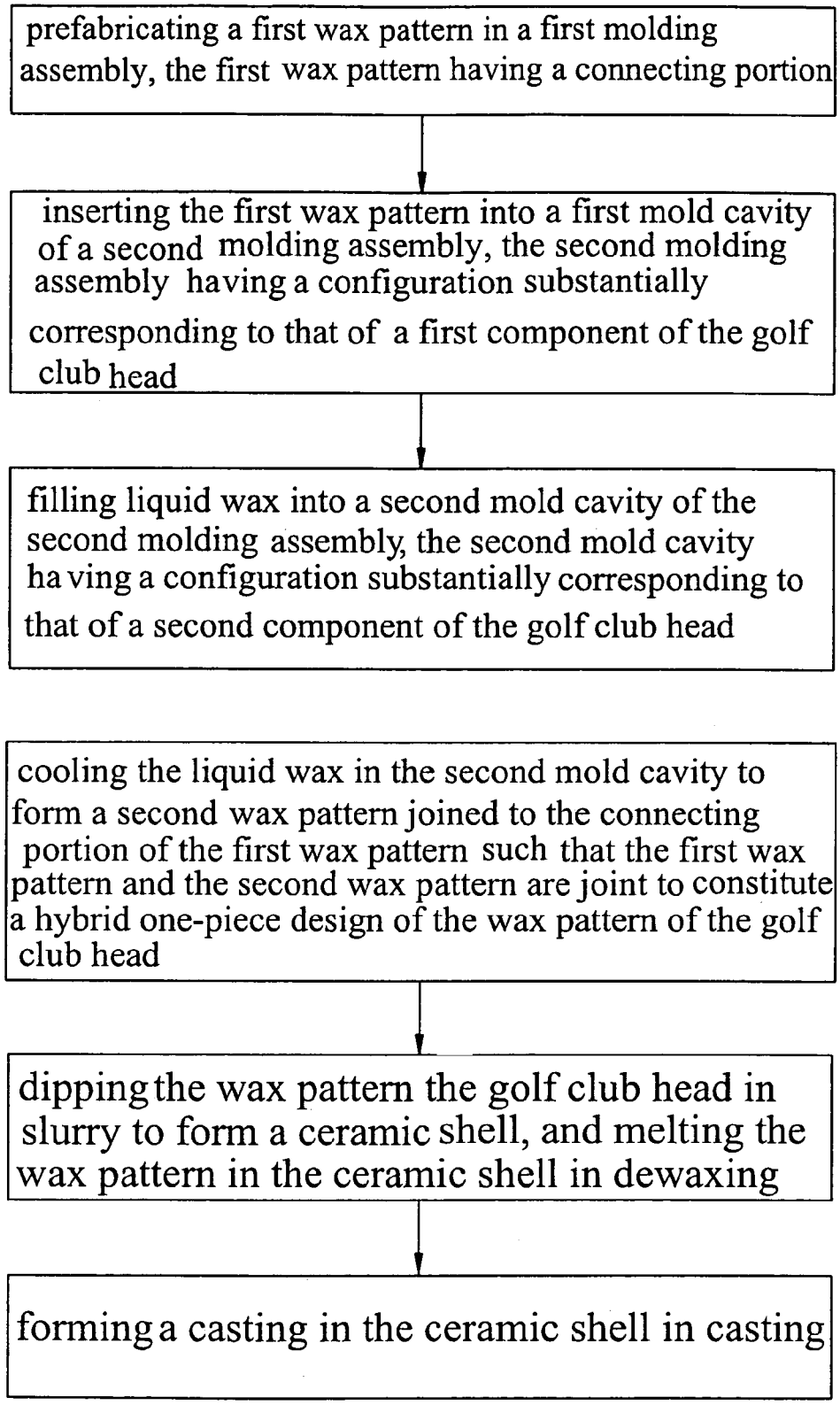
FIG. 4 is a flow chart of the manufacturing method for a golf club head in accordance with a first embodiment of the present invention.

As has been discussed above, the conventional manufacturing method for the wax pattern causes a clearance existing between the connecting portions of the club-head wax pattern 11 and the striking-plate wax pattern 12, as shown in FIG. 1. Conversely, the manufacturing method for the wax pattern in accordance with the present invention, as shown in FIG. 4, prefabricates the first wax pattern 20 to be joined to the second wax pattern 30. The first wax pattern 20 is initially inserted into the first mold cavity 301 of the second molding assembly 300, and then liquid wax is filled into the second mold cavity 302 to form a hybrid one-piece design of the wax pattern 40. Hence, there is no need for designing a complicated structure of a sectional mold core for the second molding assembly 300 for forming the first wax pattern 20 so that the manufacture process for the molding assembly is simplified and the manufacture cost is reduced. As such, the wax pattern can further avoid forming the parting lines of the molding assembly due to the conventional sectional mold core.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A manufacturing method for a golf club head, comprising the steps of:

prefabricating a first wax pattern in a first molding assembly, the first wax pattern having a connecting portion;

inserting the first wax pattern into a first mold cavity of a second molding assembly which has a configuration substantially corresponding to that of a first component of the golf club head;

filling liquid wax into a second mold cavity of the second molding assembly which has a configuration substantially corresponding to that of a second component of the golf club head;

cooling the liquid wax in the second mold cavity to form a second wax pattern joined to the connecting portion of the first wax pattern such that the first wax pattern and the second wax pattern are joint to constitute a hybrid one-piece design of the wax pattern of the golf club head;

dipping the wax pattern of the golf club head in slurry to form a ceramic shell, and melting the wax pattern in the ceramic shell in dewaxing; and forming a casting in the ceramic shell in casting.

2. The manufacturing method for the golf club head as defined in claim 1, wherein the second molding assembly includes at one mold core to engage with a periphery of the connecting portion of the first wax pattern such that no leakage of the liquid wax occurring between the first wax pattern and the mold core.

3. The manufacturing method for the golf club head as defined in claim 1, wherein the first and second wax patterns are selected from a group consisting of a weight member, a club head body, a striking plate body, a striking plate, a rear-assembling weight component, a hosel and a cover plate, a front-assembling component and a rear-assembling component.

4. The manufacturing method for the golf club head as defined in claim 3, wherein the first wax pattern is selected from the rear-assembling weight component which has a rear cavity connecting between a front side and a rear side.

5. The manufacturing method for the golf club head as defined in claim 4, wherein the rear cavity has an undercut structure.

6. The manufacturing method for the golf club head as defined in claim 1, wherein the connecting portion of the first wax pattern is formed with at least one of a stepped portion, an annular flange portion, an annular groove, and an assembling hole so as to increase connecting reliability between the first wax pattern and the second wax pattern.

7. The manufacturing method for the golf club head as defined in claim 2, wherein the mold core is constructed from a one-piece member.

8. The manufacturing method for the golf club head as defined in claim 2, wherein the mold core is constructed from a multi-piece member.

9. The manufacturing method for the golf club head as defined in claim 2, wherein the mold core made from a heat-resistant resilient material in aid of drawing out the mold core from the second molding assembly.

10. A manufacturing method for a wax pattern of a golf club head, comprising the steps of:

prefabricating a first wax pattern to have a connecting portion, the first wax pattern having a configuration substantially corresponding to that of a first component of the golf club head;

fabricating a second wax pattern jointed to the connecting portion of the first wax pattern by directly pouring liquid wax on the connecting portion of the first wax pattern, the second wax pattern having a configuration substantially corresponding to that of a second component of the golf club head; and cooling the first wax pattern and the second wax pattern such that the second wax pattern directly extending from the connecting portion of the first wax pattern to constitute a one-piece design of the wax pattern of the golf club head.

11. The manufacturing method for the wax pattern of the golf club head as defined in claim 10, further comprising the steps of:

inserting the first wax pattern into a first mold cavity of a second molding assembly which has a configuration substantially corresponding to that of the first component of the golf club head that permits directly pouring the liquid wax to form the second wax pattern;

filling the liquid wax into a second mold cavity of the second molding assembly which has a configuration substantially corresponding to that of the second component of the golf club head, the liquid wax flowing to the connecting portion of the first wax pattern;

cooling the liquid wax in the second mold cavity to form the second wax pattern joined to the connecting portion of the first wax pattern of the golf club head.

12. The manufacturing method for the wax pattern of the golf club head as defined in claim 10, wherein dipping the wax pattern the golf club head in slurry to form a ceramic shell, and melting the wax pattern in the ceramic shell in dewaxing; wherein further forming a casting in the ceramic shell in casting.

13. The manufacturing method for the wax pattern of the golf club head as defined in claim 11, wherein the second molding assembly includes at one mold core to engage with a periphery of the connecting portion of the first wax pattern such that no leakage of the liquid wax occurring between the first wax pattern and the mold core.

14. The manufacturing method for the wax pattern of the golf club head as defined in claim 10, wherein the first and second wax patterns are selected from a group consisting of a weight member, a club head body, a striking plate body, a striking plate, a rear-assembling weight component, a hosel and a cover plate, a front-assembling component and a rear-assembling component.

15. The manufacturing method for the wax pattern of the golf club head as defined in claim 14, wherein the first wax pattern is selected from the rear-assembling weight component which has a rear cavity connecting between a front side and a rear side.

16. The manufacturing method for the wax pattern of the golf club head as defined in claim 15, wherein the rear cavity has an undercut structure.

17. The manufacturing method for the wax pattern of the golf club head as defined in claim 10, wherein the connecting portion of the first wax pattern is formed with at least one of a stepped portion, an annular flange portion, an annular groove, and an assembling hole so as to increase connecting reliability between the first wax pattern and the second wax pattern.

18. The manufacturing method for the wax pattern of the golf club head as defined in claim 13, wherein the mold core is constructed from a one-piece member.

19. The manufacturing method for the wax pattern of the golf club head as defined in claim 13, wherein the mold core is constructed from a multi-piece member.

20. The manufacturing method for the wax pattern of the golf club head as defined in claim 13, wherein the mold core made from a heat-resistant resilient material in aid of drawing out the mold core from the second molding assembly.

* * * * *